United States Patent [19]

Addison

[11] 4,120,534

[45] Oct. 17, 1978

[54] APPARATUS FOR CONTROLLING THE STEERING MECHANISM OF A MINING MACHINE

[75] Inventor: George Thomas Addison, Burton-on-Trent, England

[73] Assignee: Coal Industry (Patents) Limited, England

[21] Appl. No.: 746,003

[22] Filed: Nov. 30, 1976

[30] Foreign Application Priority Data

Dec. 10, 1975 [GB] United Kingdom ..... 50604/75

[51] Int. Cl.[2] ..... E21C 35/08

[52] U.S. Cl. ..... 299/1

[58] Field of Search ..... 299/1; 250/268

[56] References Cited

U.S. PATENT DOCUMENTS 3,351,385 11/1967 Dowell ..... 299/1

3,817,578 6/1974 Wilson ..... 299/1

FOREIGN PATENT DOCUMENTS 214,464 3/1968 U.S.S.R. ..... 299/1

*Primary Examiner*—Ernest R. Purser

*Assistant Examiner*—William F. Pate, III

*Attorney, Agent, or Firm*—Stevens, Davis, Miller & Mosher

[57] ABSTRACT

Apparatus for controlling the steering mechanism of a mineral mining machine having a nucleonic sensor adapted to sense the cutting horizon of the machine's cutter head relative to a boundary of the mineral seam, the apparatus providing an electronic cavity detector which freezes the machine's steering mechanism according to two operational modes when a cavity or crack/undulation respectively is detected. Thus, the machine is not steered in accordance with an erroneous sensor signal derived when the sensor is adjacent to the cavity or crack/undulation.

7 Claims, 8 Drawing Figures

APPARATUS FOR CONTROLLING THE STEERING MECHANISM OF A MINING MACHINE

This invention relates to apparatus for controlling the steering mechanism of a mining machine and in particular to an improvement in or a modification of, the invention described and claimed in our British patent specification *Ser. No. 1,342,996.

*U.S. Patent Application No. 373,896

An object of the present invention is to provide improved apparatus which tends to be more capable of operationally negotiating cracks or undulations in a sensed surface.

According to the present invention, apparatus for controlling the steering mechanism of a mineral mining machine having a detector adapted to sense the cutting horizon of the machine relative to a boundary of a mineral seam when the machine is mining the seam, comprises first electrical means having a relatively long time constant for normally controlling the machine's steering mechanism in response to the detector's output signal, second electrical means having a relatively short time constant and adapted to override the first electrical means should the detector output signal reach a preselected condition and third electrical means sensitive to a transient difference between the outputs of the first and second electrical means, the third electrical means overriding the first electrical means when the transient difference exceeds a preselected amount.

Conveniently, the third electrical means comprises a comparator arrangement.

Preferably, the apparatus comprises means for retaining the machine's steering mechanism in a set position when the first electrical means is overridden by the second electrical means.

Preferably, the means retains the machine's steering mechanism in a set position when first electrical means is overridden by the third electrical means.

Advantageously the second electrical means effectively short circuits at least a part of the first electrical means momentarily to reduce its time constant when the detector output signal falls below the said preselected amount.

Advantageously, the third electrical means effectively short circuits at least a part of the first electrical means to reduce momentarily its time constant when the transient difference falls below a preselected amount.

According to a further aspect, the present invention provides a probe for controlling the steering mechanism on a mineral mining machine comprising apparatus as mentioned above.

According to a still further aspect, the present invention provides a mineral mining machine comprising apparatus as mentioned above.

By way of example only, two embodiments of the present invention will be described with reference to the accompanying drawings in which:

FIG. 1 is a block electrical circuit diagram of apparatus constructed in accordance with the present invention, FIG. 2 shows a more detailed electrical circuit diagram of part of FIG. 1, FIGS. 3, 4, 5 shows three typical electrical signals in different parts of the circuit of FIG. 1, FIG. 6 shows a typical electrical signal in a part of the circuit of FIG. 1 when part of the circuit of FIG. 1 is operating in a differing mode.

FIGS. 7 and 8 are drawn on a larger scale than FIGS. 1 to 6.

Figure 1:
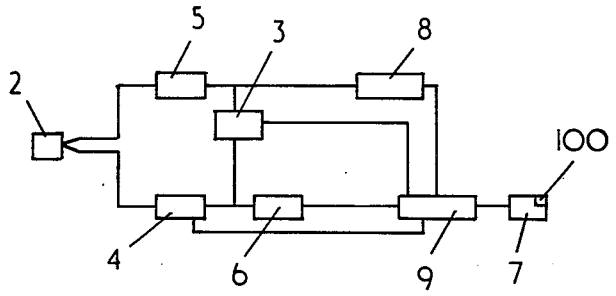

In operation, the apparatus constructed in accordance with the present invention is mounted, for example, for controlling the steering mechanism of a longwall shearer type coal mining machine which traverses to and fro along a flexible armored face conveyor winning coal from the face by means of a rotary cutter drum and loading the won coal onto the conveyor. As the machine traverses to and fro along the face the cutting horizon of the cutter drum relative to a boundary of the coal e.g. the roof of the seam, is automatically controlled by the machine's steering mechanism which is actuated in response to signals from a sensing probe mounted adjacent to the rear of the cutter drum and arranged to sense the thickness of a layer of roof coal left by the cutter drum. The probe which is carried on an arm and which is urged towards the mine roof, comprises a nucleonic source adapted to project radiation through the layer of roof coal towards the rock strata lying directly above the coal seam and a detector of radiation adapted to detect the amount of radiation backscattered from the rock strata and to produce a signal having a count-rate indicative of the amount of backscatter detected. The source and detector are geometrically arranged on the probe so that the count-rate of the detector signal increases up to a saturation value as the distance of the probe from a backscattering interface is increased, examples of backscattering interface being an air/coal boundary or a coal/rock boundary. Thus until saturation is reached, the count-rate of the detector signal enables the distance of the probe from the backscattering interface to be sensed. After the saturation value is reached the count-rate of the detector signal depends upon the backscattering taking place in the mineral existing between the probe and interface, the amount of backscattering taking place in the material being substantially proportional to the density of the material.

If as the machine traverses along the face, the probe is kept in contact with the mine roof the count-rate of the detector signal is to some extent proportional to the thickness of the layer of roof coal left by the cutter drum. The radiation which normally is emitted by the source into the layer of coal travels through the coal towards the rock strata lying directly above the coal.

Although some backscattering of the radiation will take place in the coal, at relatively small thicknesses of coal most backscattering will come from the coal/rock boundary which as previously explained enables the distance of the probe from the coal/rock boundary to be sensed, i.e. the thickness of coal to be sensed. As the coal thickness increases saturation is eventually reached with substantially all backscattering taking place in the coal, after saturation is reached the thickness of the coal layer cannot be sensed.

Thus until saturation is reached it is possible for the probe to sense the thickness of coal layer left by the cutter drum and to steer the machine along a preselected path relative to the seam boundary.

However, if an air gap is formed above the probe as would occur when the roof above the cutter drum falls as the adjacent coal is won to form a roof cavity, the radiation is emitted from the source into air and a portion is reflected back into the air at the air/coal or air/-rock boundary to be detected as backscattered radiation by the machine's detector. Since air has a relatively low density compared to the density of coal little of the backscattered radiation tends to be absorbed by the air and therefore a relatively large amount of backscattered radiation is detected by the detector. This relatively large amount of backscattered radiation detected causes the detector to tend to produce a corresponding high count-rate signal.

Referring now to the drawings, and particularly to FIG. 1 the apparatus comprising the present invention is arranged so as to receive the signal from the detector (not shown) and comprises a rate-meter 2 which monitors the count-rate of the detector output signal and generates a D.C. signal indicative of the monitored count-rate and hence of the amount of backscatter received by the detector.

The signal from the ratemeter is fed into two electrical means 4 and 5 arranged in parallel. One of these means 4 has a relatively long time constant and therefore does not respond to, or transmit, relatively high frequency changes in the ratemeter output signal. The output signal from the means 4 is fed to an electrical control means 6 which normally actuates the electrical/hydraulic steering mechanism 7 in response to this output signal. The apparatus as described so far is typical of the steering apparatus used to steer longwall mining machines. The means 4 does not respond to, or transmit, relatively high frequency changes in the ratemeter output signal in order to avoid continuous adjustment of the machine's steering mechanism due to momentary changes in the output signal from the ratemeter.

The second electrical means 5 has a relatively short time constant and, therefore, does respond to, and transmit, relatively high frequency changes in the ratemeter output signal. The output signal from the electric means 5, which because of its short time constant tends to have high noise content, is fed to an electrical control means 8 which upon the output from the means 5 exceeding a preselected value operates an electric relay 9 inserted intermediate the control means 6 and the steering mechanism 7.

The outputs from the two electrical means 4 and 5 are also connected to third electrical means 3, which upon the transient difference between the outputs from the means 5 and 6 reaching a preselected amount, small in comparison with the said preselected value, operates the electric relay 9.

Figure 2:
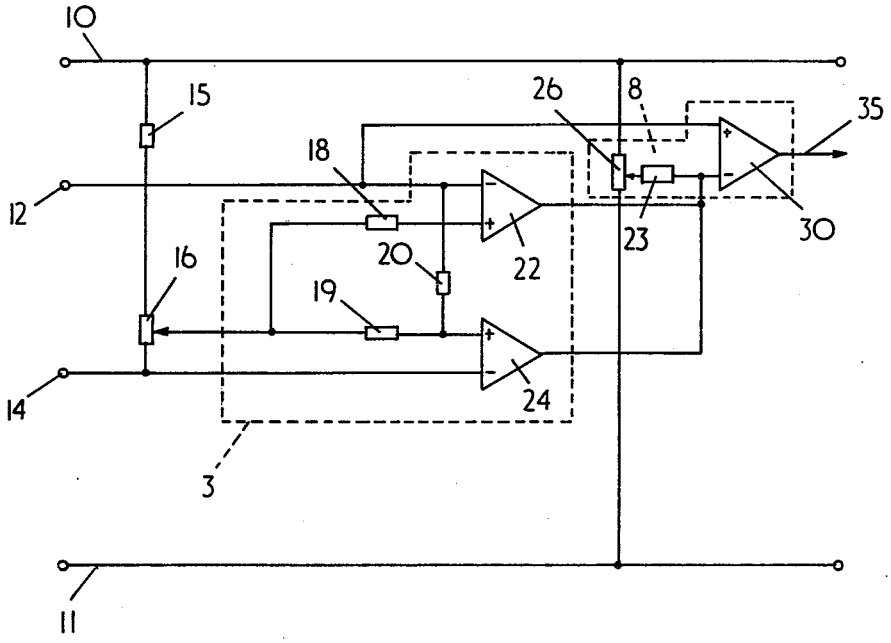

The third electrical means 3, which comprises a comparator arrangement, and the electrical control means 8 are now described with reference to FIG. 2. The output signal from the first means 4 is fed to terminal 14 in FIG. 2 and the output signal from the second means 5 is fed to terminal 12. The terminal 12 and 14 are connected to the third electrical means comprising the comparator arrangement indicated at 3. The comparator arrangement 3 and the control means 8 are shown between stabilized voltage rails 10 and 11. In the example, the rail 10 is stabilized at +5 volts and the rail 11 is stabilized at −5 volts.

A variable resistor 26 is connected between the rails 10 and 11. The wiper of the resistor 26 is connected via a resistor 23 to a comparator 30. The terminal 12, which carries the signal from the short time constant means 5 is also connected to the comparator 30 which has an open collector transistor (not shown) on its output.

The output of the comparator 30 is low when the signal from the terminal 12 is less than the value of the preselected voltage level tapped from the resistor 26, the latter value being set at 2.4 volts in this example. However, should the input voltage from terminal 12 exceed the preselected voltage level, then the comparator 30 goes high.

The output from the comparator 30 is connected to operate the relay 9 mentioned previously when the output from comparator 30 goes high. From the description above, it can be seen that the relay 9 is operated when the signal from the short time constant means 5 exceeds a preselected amount.

The comparator arrangement 3 comprises two comparators 22 and 24 and resistors 18 and 19. The comparators 22, and 24 have open collector transistors (not shown) in their outputs. A variable resistor 16 in series with a resistor 15 is connected between the rail 10 and a line between the terminal 14 and a first of two inputs of the comparator 24.

The wiper of the variable resistor 16 is connected to a first of two inputs of the comparator 22 via a resistor 18. The signal from the wiper of resistor 16 is combined with the signal from the short time constant means through terminal 12, the former signal passing through the resistor 19 and the latter signal through the resistor 20 and the composite of the signals is fed to the other input of the comparator 24. The signal from the short time constant means is fed directly to the other input of the comparator 22. The outputs of the comparators 22 and 24 are fed to the input of the comparator 30 which is connected to the wiper of the resistor 26 described previously.

If the signal from the short time constant means 5 does not differ from the signal from the long time constant means by an amount exceeding the preselected amount defined by the value of voltage tapped from variable resistor 16, then the outputs from both comparators 22 and 24 are high.

However, if the signal from the short time constant means exceeds the signal from the long time constant means by more than the preselected amount set by resistor 16, then the output of comparator 22 will change from high to low. If this happens then the output from the comparator 30 changes from low to high. As mentioned above, when the comparator 30 goes from low to high, then the relay 9 is operated as mentioned previously.

Alternatively, if the signal from the short time constant means falls below the signal from the long time constant means by more than the preselected amount, then the output from the comparator 24 changes from high to low. If this happens then the output from the comparator 30 again changes from low to high and the relay 9 is operated.

When the deviations over the preselected level and the preselected amount disappear, then the relay 9 is deactivated so that the means 4 steers the machine according to normal operation.

Figure 3:
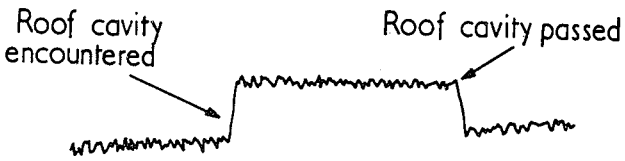

In operation as the machine traverses along the face, the probe senses the seam boundary and the machine control steering system automatically steers the machine's cutting horizon along the preselected path relative to the seam boundary. However, if the rock strata above the coal seam breaks and falls before the passage of the probe an air gap is formed which subsequently results in a relatively high count-rate output signal from the detector and a correspondingly high D.C. output signal means 4 and 5. The increase in the ratemeter output signal resulting from the probe reaching a roof cavity can be seen in FIG. 3.

Figure 4:
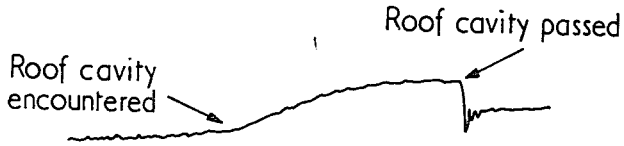

The effect of the increased ratemeter output signal upon the means 4 can be seen in FIG. 4 which shows the corresponding output signal from the means. Although the rate of increase of the D.C. output signal from the ratemeter is relatively rapid, because the means 4 has a relatively long time constant it is unable to follow the relatively rapid rate of increase in the ratemeter output signal but instead increases at a slower rate as can be seen in FIG. 4.

Figure 5:
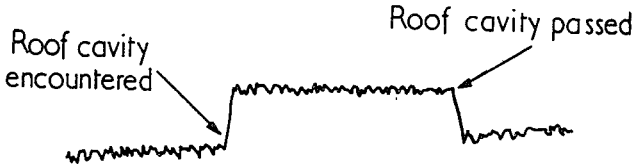

The effect of the increased ratemeter output signal upon the means 5 can be seen in FIG. 5, which shows the corresponding output signal from this means. As mentioned previously, the means has a high noise content. Since the means 5 has a relatively short time constant, it can follow the relatively rapid rate of increase of the signal fed from the ratemeter.

The output signal from the means 5 is fed to the electrical control means 8 which upon sensing the increase is the output signal of the means 5 due to the probe reaching a roof cavity actuates the electrical relay 9 to effectively disconnect the control means 6 from the steering mechanism 7 which then stays set in position i.e. the steering mechanism is frozen until the control means 6 is re-connected. The steering mechanism 7 can be retained in position by any suitable means as for example, by having a spring load check-value indicated schematically at 100 arranged to close when the control means 6 is disconnected.

Upon the probe passing the roof cavity, an air gap no longer exists between the probe and the rock surface and the detector output signal reverts back to its normal operating count-rate. The ratemeter output signal falls correspondingly as can be seen in FIG. 2 and the corresponding signal from the means 5 falls rapidly as can be seen in FIG. 5.

The control means 8 actuates the relay 9 to re-connect the control means 6 to the steering mechanism 7. As the relay 9 is actuated a pulse is derived which effectively short circuits a component on the means 4 so as to override its long time constant causing the output signal from the means 4 to fall rapidly to its normal operating value. Thus upon the probe passing the roof cavity the machine rapidly becomes automatically steered.

Figure 7:
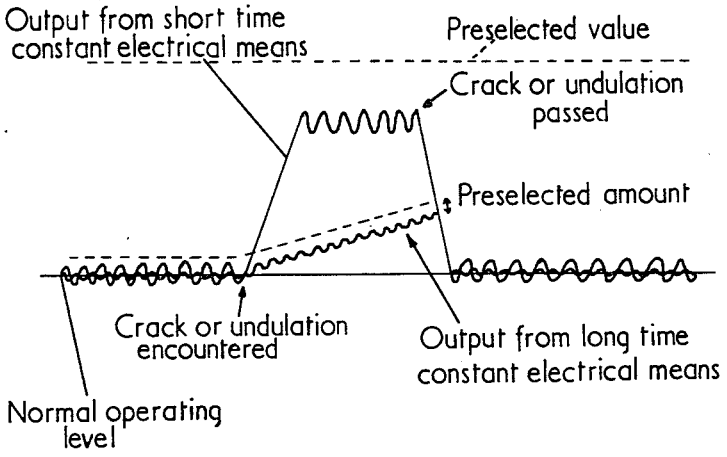
FIG. 7 shows a comparison between two signals in different parts of the circuit of FIG. 1.

If the probe should pass a crack in the roof or negotiate an undulation in the roof, then the count rate will be increased. As indicated in FIG. 7 this increase may be insufficient for the output of ratemeter 2 to reach the said preselected value. However, a transient difference in output will occur between the electrical means 5 and the electrical means 4. This difference will be detected by the previously described electrical comparator arrangement 3, which will, should the difference exceed the previously mentioned preselected amount for more than, for example, a second, actuate the relay 9 to disconnect the control means 6 from the steering mechanism 7.

It may be seen from FIG. 7, that the steering mechanism will be locked while the probe is negotiating the crack or undulation since the difference between the output from the electrical means 5 and the electrical means 4 exceeds the said preselected amount.

Upon passing the crack or undulation, immediately the difference is less than the preselected amount, the relay 9 is closed, the component in the means 4 short-circuited to override its long time constant and the control means 6 reconnected to the steering mechanism 7. Thus upon passing the crack or undulation in the roof the machine rapidly becomes automatically steered.

Figure 6:
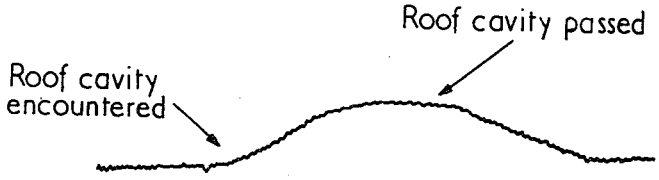
Figure 8:
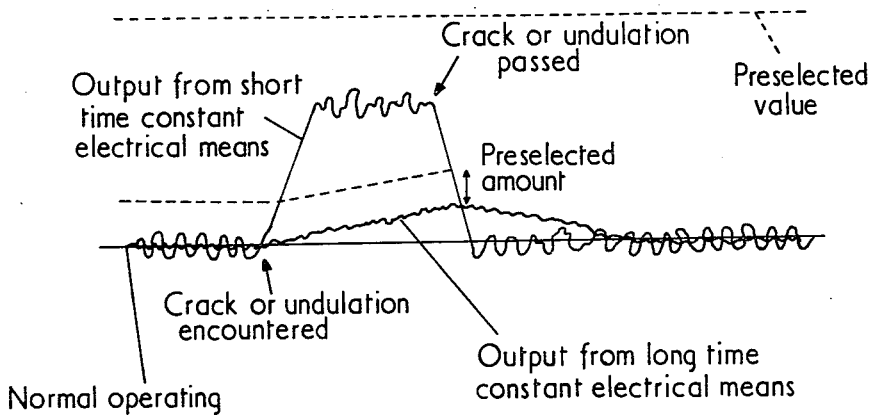
FIG. 8 shows a comparison between two signals in different parts of the circuit of FIG. 1 when the circuit is operating according to the mode of FIG. 6.

In another embodiment of the invention, described with reference to FIGS. 6 and 8, the relay 9 does not derive a pulse to short circuit a component of the long time constant electrical means 4. In this embodiment, the long time constant means gradually moves towards its normal operating level, after passing a cavity, crack or undulation in the roof. This mode of operation is clearly seen in FIGS. 6 and 8, which correspond to FIGS. 5 and 7 respectively, and wherein it can be seen the means 4 slowly follows the ratemeter 2 and means 5. The steering of the mining machine is frozen until the signals from the means 4 and 5 fall again to within the preselected amount, at which time the machine resumes normal steering.

The fact that the steering mechanism 7 is retained in a set position or frozen when the relay 9 is actuated prevents uncontrolled steering of the machine.

From the above description it will be seen that the present invention provides apparatus which avoids the problems encountered with a mechanical roof cavity detector and which is relatively, simple reliable and inexpensive.

I claim:

1. Apparatus for controlling the steering mechanism of a mining machine having a detector for sensing the cutting horizon of the machine relative to the boundary of a mineral seam when the machine is mining in the seam, comprising first electrical means having a relatively long time constant for normally controlling the machine's steering mechanism in response to the detector's output signal, second electrical means having a time constant which is relatively short compared to the time constant of said first electrical means for overriding said first electrical means should the detector output signal reach a preselected condition, and third electrical means sensitive to a transient difference between the outputs of said first and second electrical means, said third electrical means overriding the first electrical means when the transient difference exceeds a preselected amount.

2. Apparatus as claimed in claim 1, wherein the third electrical means comprises a comparator arrangement.

3. Apparatus as claimed in claim 1 comprising means for retaining the machine's steering mechanism in a set position when the first electrical means is overridden by the second electrical means.

4. Apparatus as claimed in clam 3, wherein said retaining means retains the machine's steering mechanism in a set position when said first electrical means is overridden by said third electrical means.

5. Apparatus as claimed in claim 1, wherein the second electrical means effectively short circuits at least a part of the first electrical means momentarily to reduce its time constant when the detector output signal falls below the preselected amount.

6. Apparatus as claimed in claim 1, wherein the third electrical means effectively short circuits at least a part of the first electrical means to reduce momentarily its time constant when the transient difference falls below a preselected amount.

7. A probe for controlling the steering mechanism of a mining machine including apparatus comprising first electrical means having a relatively long time constant for normally controlling the machine's steering mechanism in response to an input signal, second electrical means having a time constant which is relatively short compared to the time constant of said first electrical means for overriding said first electrical means should said input signal reach a preselected condition, and third electrical means sensitive to a transient difference between the outputs of said first and second electrical means, said third electrical means overriding said first electrical means when the transient difference exceeds a preselected amount.

* * * * *